US005081914A

United States Patent [19]

Mejia

[11] Patent Number: 5,081,914

[45] Date of Patent: Jan. 21, 1992

[54] ROOF VENT CAP

[76] Inventor: Augustine G. Mejia, 3217 Lariat La., Corpus Christi, Tex. 78415

[21] Appl. No.: 496,773

[22] Filed: Mar. 21, 1990

[51] Int. Cl.[5] ..... F23L 17/02; F16L 55/10

[52] U.S. Cl. ..... 454/367; 138/89; 454/359; 454/366

[58] Field of Search ..... 98/119, 75, 118, 122; 220/287; 138/96 R, 89

[56] References Cited

U.S. PATENT DOCUMENTS

| | | | |
|---|---|---|---|
| 263,448 | 8/1882 | Withey | 138/89 |
| 778,204 | 12/1904 | Porter | 98/118 |
| 836,333 | 11/1906 | Nelson | 98/118 |
| 893,469 | 7/1908 | Essmuller | 220/287 X |
| 1,352,022 | 9/1920 | Pajalic | 98/122 |
| 3,031,783 | 5/1962 | Burke | 98/122 |
| 3,064,552 | 11/1962 | Ehrsam et al. | 98/119 |
| 3,363,538 | 1/1968 | Stoneman et al. | 98/122 |
| 3,861,557 | 1/1975 | Tupper | 137/493.2 X |
| 4,760,773 | 8/1988 | Pezzulli | 98/75 |

FOREIGN PATENT DOCUMENTS

| | | | |
|---|---|---|---|
| 0066094 | 7/1913 | Switzerland | 220/287 |
| 0015650 | of 1904 | United Kingdom | 98/118 |

*Primary Examiner*—Albert J. Makay
*Assistant Examiner*—William C. Doerrler
*Attorney, Agent, or Firm*—Fleit, Jacobson, Cohn, Price, Holman & Stern

[57] ABSTRACT

A cap which can be attached to a roof vent pipe to form a closure for the roof vent pipe after the usual ventilating device attached to the roof vent pipe has been removed thereby trapping hot air in the attic area of a home or other building. The roof vent cap is of one-piece unitary construction secured in place by anchoring screws which may be the same screws that secure the roof ventilator in place with the cap including three depending cylindrical flanges of different lengths which can be mounted on different diameter roof vent pipes thereby rendering the cap universal in use. The variation in length enables access to anchor screws on each of the flanges.

1 Claim, 1 Drawing Sheet

ROOF VENT CAP

BACKGROUND OF THE INVENTION

1. Field of the Invention

The present invention generally relates to a roof vent cap and more specifically a cap which can be attached to a roof vent pipe to form a closure for the roof vent pipe after the usual ventilating device attached to the roof vent pipe has been removed thereby trapping hot air in the attic area of a home or other building. The roof vent cap is of one-piece unitary construction secured in place by anchoring screws which may be the same screws that secure the roof ventilator in place with the cap including three depending cylindrical flanges of different lengths which can be mounted on different diameter roof vent pipes thereby rendering the cap universal in use. The variation in length enables access to anchor screws on each of the flanges.

2. Information Disclosure Statement

Most buildings having attics include a ventilating system which includes a vent pipe with a ventilating device on the upper end thereof which exhausts heated air from the attic. This is especially useful in the summertime when air in the attic sometimes reaches a relatively high temperature. Turbine ventilators are frequently used which are rotatable by wind action to rotate a fan which exhausts hot air from the attic thereby reducing the tendency of the hot air to migrate into a living space through a ceiling by radiant heat and the like. The ventilation system is usually provided with ventilating openings in the soffit which introduce air into the attic to enable circulation up through the attic for discharge of hot air. In the wintertime, it is desirable to trap the hot air in the attic to assist in heating the living space below the ceiling. In order to do this, the present invention utilizes a cap which closes the roof vent pipe and replaces the turbine ventilator or other ventilator normally mounted on the upper end of the roof vent pipe thereby trapping the hot air in the roof during cold temperature periods to facilitate heating the house or living space. The prior art does not disclose such a roof vent cap.

The following U.S. Pat. Nos. disclose structures which relate to this invention:

Des. 274,935
2,708,950
2,791,448
4,231,288
4,287,816
4,374,534
4,582,250

SUMMARY OF THE INVENTION

An object of the present invention is to provide a roof vent cap of unitary construction of plastic or other suitable material including metal or combinations thereof in which the cap is adapted to replace a turbine ventilator or other conventional ventilator mounted on top of a roof vent pipe or base which communicates with the attic space of a home or other building to normally vent hot air from the attic space during periods of hot weather with the cap of the present invention trapping the hot air in the attic space during periods of cold weather thereby assisting in the heating of living space below a ceiling by heating the ceiling due to contact with the heated air in the attic space thus warming the living space below the ceiling.

Another object of the invention is to provide a roof vent cap in accordance with the preceding object in which the cap includes a generally circular pan or plate forming a closure for the roof vent pipe with the pan or plate including a plurality of downwardly extending cylindrical flanges with the innermost flange being longer than the outermost flange or flanges for telescopic engagement over different diameter roof vent pipes.

A further object of the invention is to provide a roof vent cap in accordance with the preceding objects in which each of the cylindrical flanges is provided with a plurality of anchor holes for receiving anchor screws which may be the same anchor screws which retain the turbine ventilator or other ventilator in place on the upper end of the roof vent pipe.

Still another object of the invention is to provide a roof vent cap which can be installed in just a few minutes and will effectively close the roof vent pipe to trap hot air in the attic space with the roof vent cap being preferably constructed of plastic material and provided with reinforcing ribs in the various areas thereof for providing a long-lasting and effective roof vent cap.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
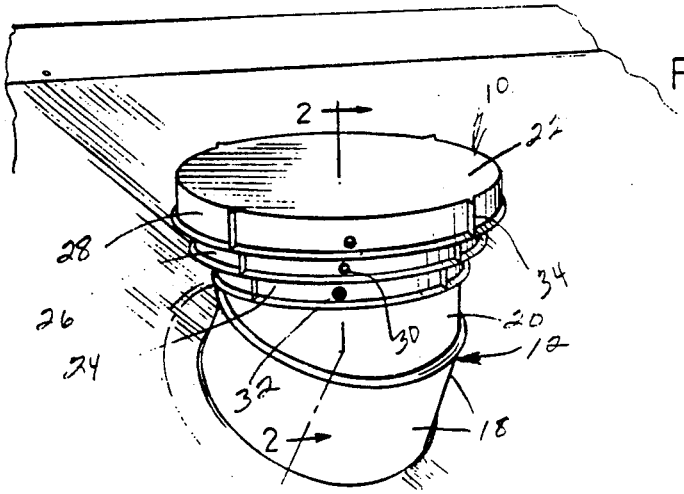
FIG. 1 is a perspective view of the roof vent cap of the present invention installed on a roof vent pipe.

The roof vent cap of the present invention is generally designated by reference numeral 10 and is mounted on a roof vent pipe generally designated by reference numeral 12 which is communicated with the interior attic space 14 below a roof structure 16. The roof vent pipe 12 normally supports a ventilator device such as a turbine ventilator and the attic space 14 is normally provided with ventilating apertures in the soffit to provide air flow through the attic space to remove heated air trapped therein during periods of high temperatures such as in the summertime. The roof vent pipe 12 includes a base section 18 which is perpendicular to the inclined roof 16 and an upper end portion 20 which is vertically disposed and is of cylindrical configuration with the vent pipe 12 normally being of a standard diameter such as a diameter of 12", 14" or 16". The upper end of the upper portion 20 of the vent pipe supports a ventilating device such as a turbine ventilator or the type of ventilator using gravity flow rather than a turbine driven fan. While the turbine ventilator operates in the summer to remove heated air from the attic to reduce the tendency of the heated air in the attic to heat the living space below the ceiling forming the attic space, in the wintertime, it is desirable to not remove the heated air in order to warm the living space below the ceiling. Thus, the vent cap of the present invention replaces the turbine ventilator or other ventilator which is removed from the roof vent pipe 12.

The vent cap 10 includes a substantially flat, circular plate or pan 22 which includes three depending cylindrical flanges 24, 26 and 28 with the flanges 24, 26 and 28 having an internal diameter to fit the different sized roof vent pipes. For example, the cylindrical flange 24 is provided with an inside diameter of just slightly more than 12" to telescope downwardly over a roof vent pipe having an outside diameter of 12". Also, as illustrated, the flanges 24, 26 and 28 each is provided with a different length with the flange 24 being the longest, the flange 26 being of medium length and the flange 28 being shorter thereby providing access to apertures 30 in each of the flanges as illustrated in FIG. 1 thereby enabling anchor screws such as set screws 32 to be utilized to secure the vent cap to the vent pipe 12. The difference in length enables the flange 24, 26 or 28 to be engaged with the vent pipe and the anchor screw 32 secured in place to quickly and securely anchor the vent cap in place on the vent pipe 12.

Figure 3:
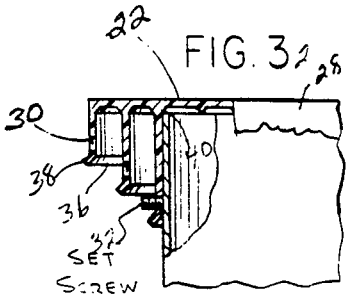
FIG. 3 is an enlarged, fragmental, sectional view of the roof vent cap illustrating in more detail the specific structure of the flanges and anchor screw.
Figure 2:
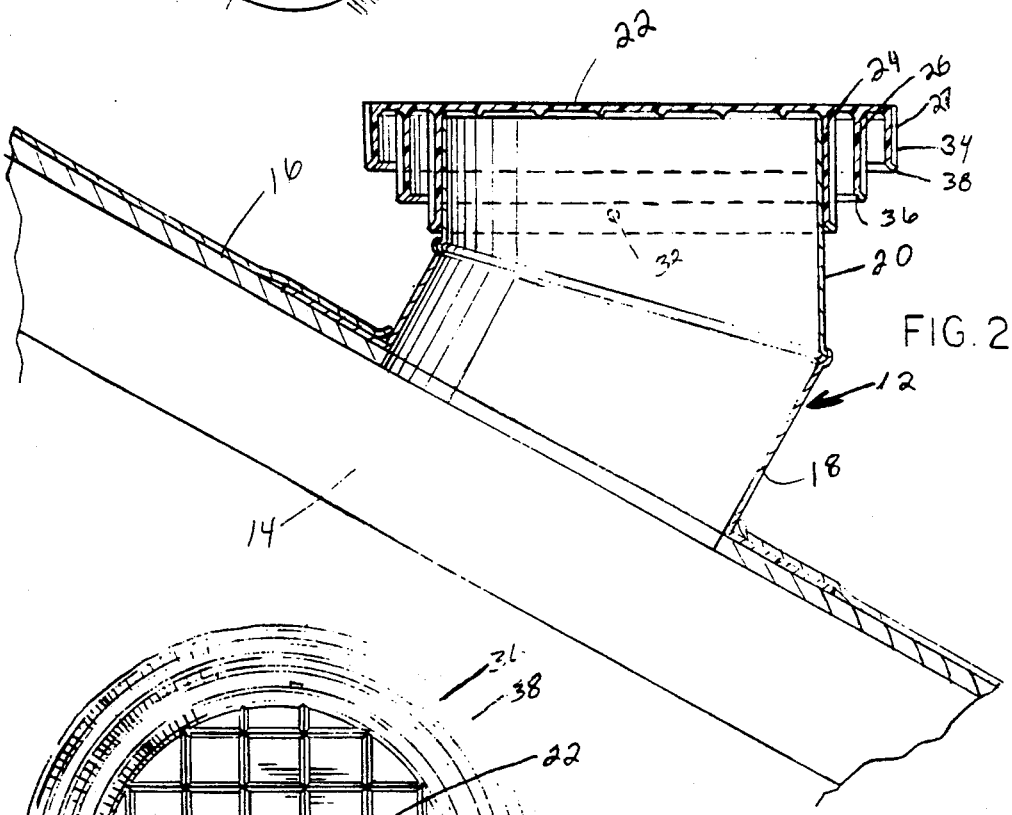
FIG. 2 is a vertical, sectional view, on an enlarged scale, taken substantially upon a plane passing along section line 2—2 on FIG. 1 illustrating the specific construction of the roof vent cap and its association with a roof vent pipe.
Figure 4:
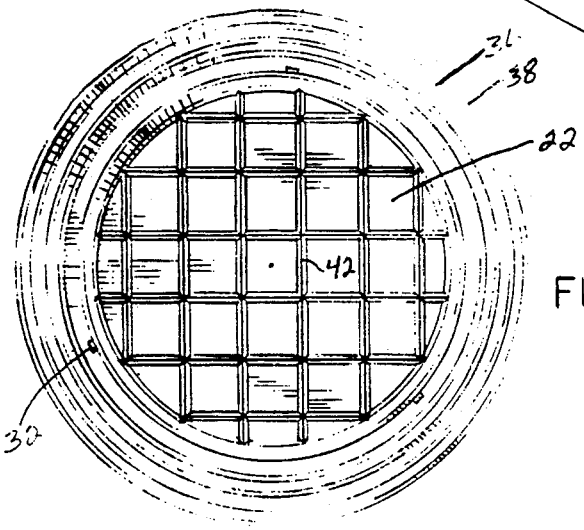
FIG. 4 is a bottom plan view of the roof vent cap of the present invention.

The flanges 24, 26 and 28 each have a plurality of vertical ribs 34 on the exterior surface thereof and the lower edge of each flange is outwardly flared as at 36 and provided with a peripheral rib or bead 38 for increased rigidity as illustrated in FIG. 3. Also, the upper end of each of the flanges is provided with a gusset 40 in the juncture of the flange with the plate or pan 22 thereby further strengthening the flanges 24, 26 and 28. The undersurface of the plate or pan 22 is provided with a reinforcing rib arrangement 42 in the form of a grid which reinforces the plate or pan 22 to maintain it substantially rigid in construction.

Each of the flanges includes three apertures and receives three set screws which are equally spaced around the periphery of the flanges with this structure enabling easy assembly and quick assembly of the vent cap on the existing roof vent pipe 12. In practical use, the ventilating apertures in the soffit provide sufficient ventilation to prevent moisture accumulation in the attic space. However, by trapping heated air in the attic space, especially on sunny days, the living space below the ceiling will be warmed by the heated air in the attic thereby reducing the fuel necessary to warm the living space. This provides a substantial savings in energy costs and reduces the consumption of various types of heating fuels. In addition, the temperature interiorly of a home or living space is maintained at a higher level and the radiant heat from the warmed ceiling produces an even temperature throughout the living space.

Installation of the roof vent cap 10 is quite simple and requires very little time. It is only necessary to remove the anchor screws or set screws holding the turbine ventilator or other conventional ventilator mounted on top of the base of the roof vent pipe. The roof vent cap of this invention is then merely slid down onto the open upper end of the roof vent pipe with the appropriate flange 24, 26 or 28 telescoping over the upper end of the roof vent pipe. The set screws or anchor screws which held the turbine ventilator in place are then used to secure the roof vent cap to the roof vent pipe thereby trapping heated air within the attic space.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination, a cylindrical roof vent pipe extending through and above a roof structure and having an upper end terminating above the roof structure and a lower end in communication with an attic space to exhaust heated air from the attic space, a cap forming a closure for the upper end of the roof vent pipe, said cap comprising an imperforate member overlying and engaging the upper end of the roof vent pipe and forming a closure for the upper end thereof, and means on said member to removably secure said member to the roof vent pipe, said imperforate member being a generally flat circular plate having a diameter slightly greater than the diameter of the roof vent pipe, said means securing said member to the roof vent pipe including a depending cylindrical flange unitary with said plate in close telescopic relation to the exterior of a portion of the upper end of the roof vent pipe, said flange including a plurality of anchor screws anchoring the flange and plate to the roof vent pipe to enable complete separation of the flange and plate from the roof vent pipe, and at least one additional depending cylindrical flange on said plate in outward concentric spaced relation to said first mentioned flange, said additional flange including a plurality of anchor screws, each additional flange being shorter in height than the first mentioned flange, said anchor screws on the first mentioned flange being located adjacent the lower edge thereof and below the bottom edge of the additional flange to enable radial access to the anchor screws on the first mentioned flange.

* * * * *